US009071015B1

(12) United States Patent
Tan et al.

(10) Patent No.: US 9,071,015 B1
(45) Date of Patent: Jun. 30, 2015

(54) ELECTRICAL CONNECTOR

(71) Applicant: J.S.T. CORPORATION, Farmington Hills, MI (US)

(72) Inventors: Tommy Chin Yaw Tan, Singapore (SG); Ted Tiong Hwee Loo, Singapore (SG); Jason Yao Hui Mah, Singapore (SG)

(73) Assignee: J.S.T. CORPORATION, Farmington Hills, MI (US)

( * ) Notice: Subject to any disclaimer, the term of this patent is extended or adjusted under 35 U.S.C. 154(b) by 17 days.

(21) Appl. No.: 14/101,730

(22) Filed: Dec. 10, 2013

(51) Int. Cl.
*H01R 13/641* (2006.01)
*H01R 13/627* (2006.01)

(52) U.S. Cl.
CPC ..... *H01R 13/627* (2013.01)

(58) Field of Classification Search
CPC ..... H01R 13/6272; H01R 13/6275; H01R 13/641; H01R 13/465; H01R 2103/00; H01R 13/7032; H01R 13/639
See application file for complete search history.

(56) References Cited

U.S. PATENT DOCUMENTS

| | | | | |
|---|---|---|---|---|
| 5,586,902 | A | 12/1996 | Hopf | |
| 6,435,894 | B2 | 8/2002 | Little | |
| 6,739,913 | B2 | 5/2004 | Hayashi | |
| 6,866,534 | B2 * | 3/2005 | Hirschmann | 439/352 |
| 6,910,902 | B2 | 6/2005 | Osada | |
| 6,945,801 | B2 | 9/2005 | Brown | |
| 6,997,750 | B2 | 2/2006 | Johannes | |
| 7,303,423 | B2 | 12/2007 | Hayashi | |
| 2001/0009818 | A1 * | 7/2001 | Hirschmann | 439/352 |
| 2003/0162444 | A1 | 8/2003 | Hayashi | |
| 2006/0014413 | A1 * | 1/2006 | Annecke | 439/352 |
| 2008/0248668 | A1 * | 10/2008 | Ripper et al. | 439/188 |

* cited by examiner

*Primary Examiner* — Gary Paumen

(74) *Attorney, Agent, or Firm* — Kratz, Quintos & Hanson, LLP

(57) ABSTRACT

An electrical connector having a squib connector and a squib assembly for mating by moving them together in a mating direction. A retaining means is provided for retaining the squib connector and squib assembly in a fully mated condition. A spring, acting in a direction opposite the mating direction, provides a resisting force to oppose mating. During the application of a mating force to overcome the resisting force of the spring and move the squib connector and squib assembly in the mating direction, and prior to the squib connector and squib assembly reaching the fully mated condition, removal of the resisting force of the spring is triggered and the mating force is instantly applied to moving the squib connector and squib assembly to the fully mated condition, whereat the retaining means is activated. The spring is molded to have features that assure dependable operation of the connector.

14 Claims, 7 Drawing Sheets

ELECTRICAL CONNECTOR

BACKGROUND OF THE INVENTION

1. Field of the Invention

In a motor vehicle inflatable airbag system, a squib assembly is used as a heat generator for feeding a gas into the airbag. The squib assembly is connected to a squib connector in order to supply electrical energy to the squib assembly. The present invention is a squib assembly and a squib connector having a configuration to assure complete mating of the squib assembly and the squib connector. With the present configuration, the prevention of incomplete mating is accomplished without the use of a CPA (Connector Position Assurance) or a "shorting clip", which are used for this purpose in many Prior Art connectors of this type. The present invention features a "Go/No Go" function to assure mating of the squib assembly and squib connector. The "Go/No Go" function is described below.

2. Discussion of the Relevant Art

U.S. Pat. Nos. 6,435,894, 6,945,801, 6,910,902, 6,997,750, 5,586,902, 6,739,913 and 7,303,423 and U.S. Published Application 20030162444 are directed to electrical connectors of the squib connector type, however they do not prevent incomplete mating in the manner of the present invention. The electrical connectors of the indicated patents and published application do not provide a "Go/No Go" function for assuring complete mating of the squib assembly and squib connector as does the present invention.

SUMMARY OF THE INVENTION

An electrical connector of the present invention has a squib connector of an electrical insulating material for housing a plurality of socket contacts, a squib assembly of an electrical insulating material for housing a plurality of pin contacts for insertion in the socket contacts when the squib connector and squib assembly are moved together in a mating direction and mated, a retaining means for retaining the squib connector and squib assembly in a fully mated condition, the retaining means is self activated when the squib connector and squib assembly are fully mated, and a spring, acting in a direction opposite the mating direction, provides a resisting force to oppose mating. During the application of a mating force to overcome the resisting force of the spring and move the squib connector and squib assembly in the mating direction, and prior to the squib connector and squib assembly reaching the fully mated condition, removal of the resisting force of the spring is triggered and the mating force is instantly applied to moving the squib connector and squib assembly to the fully mated condition, whereat the retaining means is activated.

The spring is formed of a plastic material to have: a spring body having a lower portion and an upper portion, the upper portion having a central opening extending upwardly to an upper edge of the spring body to partially define first and second shoulders, first and second arms extending outwardly from the first and second shoulders respectively, and the lower portion, shoulders and first arm disposed in a first plane and the second arm disposed in a second plane intersecting the first plane.

The spring is formed to provide a resistance force when ends of the arms are moved toward a lower edge of the spring; the ends of the arms bear on the squib connector; the squib assembly includes a ledge; and the lower edge of the spring bears on the ledge.

In the electrical connector of the invention, the squib connector includes a spring activator and during movement of the squib connector and squib assembly in the mating direction, the spring activator contacts the spring to displace the spring from the ledge, thereby removing the resisting force of the spring.

Further in the electrical connector of the invention, the retaining means has a lip on the squib assembly and a lock lever on the squib connector, the lock lever being biased toward the lip and free to engage the lip only when the squib connector and squib assembly are fully mated.

In the electrical connector of the invention the spring body includes a guide rib for guiding the spring in the squib assembly.

In the electrical connector of the invention the spring body includes a protrusion on the lower edge, the protrusion being contacted by the spring activator during displacing the spring from the ledge.

In the electrical connector of the invention, the spring is molded of plastic and is preferably molded of PBT.

In one embodiment of the electrical connector of the invention, the spring and squib are molded as a single piece.

DETAILED DESCRIPTION OF THE PREFERRED EMBODIMENT

The present invention is a squib assembly and a squib connector having a configuration to assure complete mating of the squib assembly and squib connector by providing a "Go/No Go" function when being mated.

In the following description of the invention, the squib assembly and squib connector are described, however use of the invention is not necessarily limited to electrical connectors of this type.

Figure 2A:
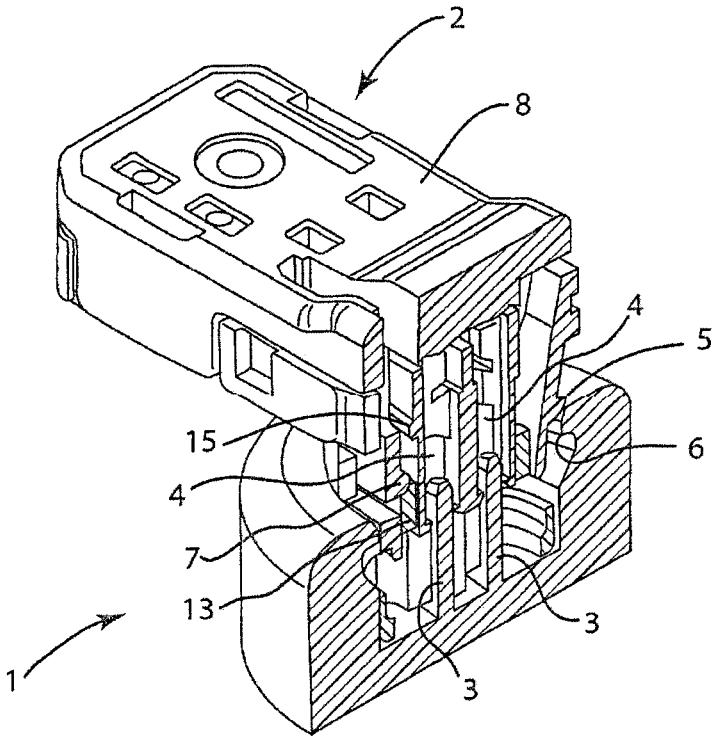
FIG. 2*a* is a perspective view of the squib connector and squib assembly of the electrical connector of the invention, having a portion in cross-section taken at section b-b shown in FIG. 1*a*, at an intermediate insertion position.
Figure 2B:
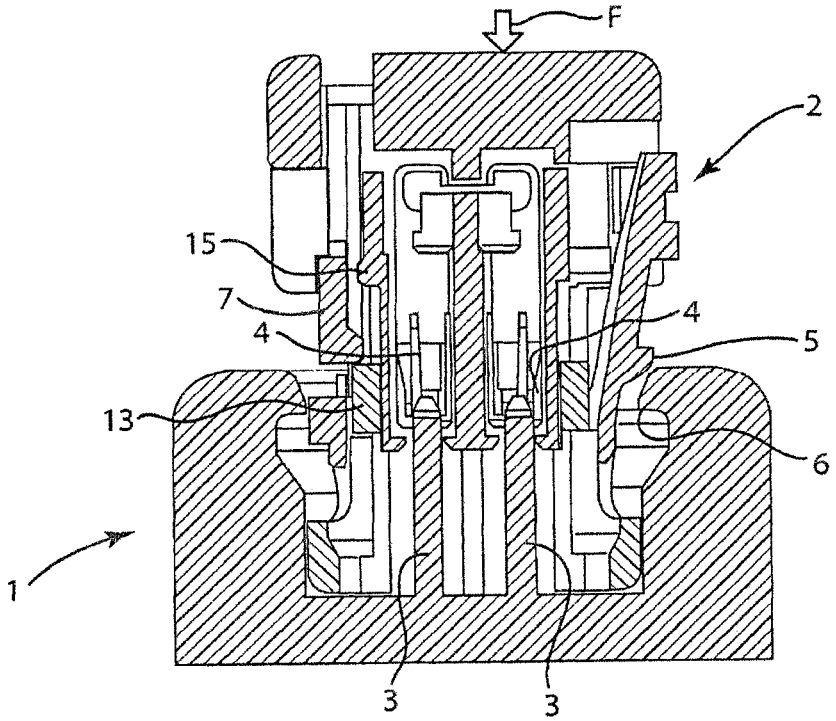
FIG. 2*b* is a cross-sectional view of the squib connector and squib assembly of the electrical connector of the invention, taken at section b-b shown in FIG. 1*a*, at the intermediate insertion position.
Figure 3A:
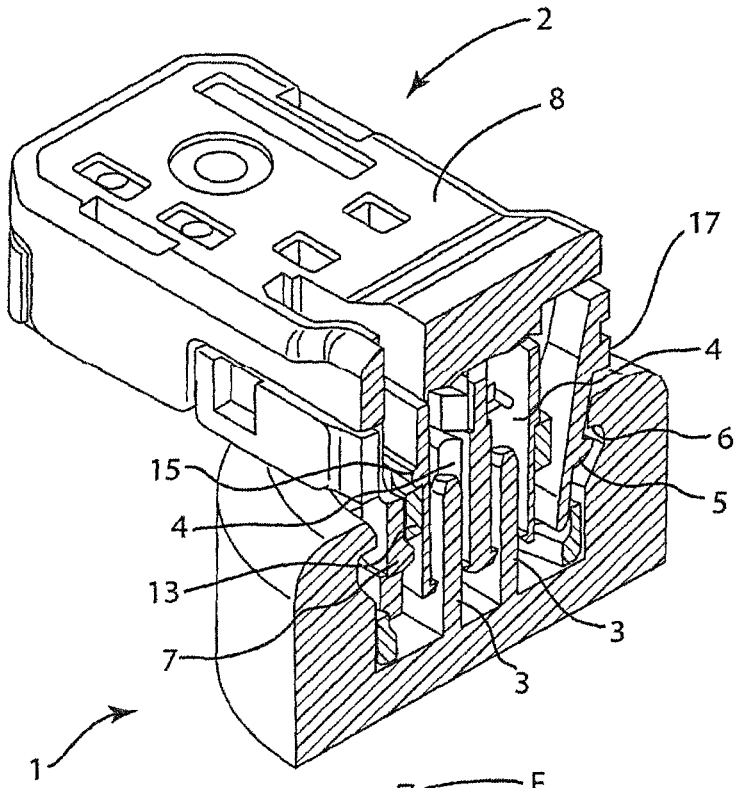
FIG. 3*a* is a perspective view of the squib connector and squib assembly of the electrical connector of the invention, having a portion in cross-section taken at section b-b shown in FIG. 1*a*, at a fully mated and locked insertion position.
Figure 3B:
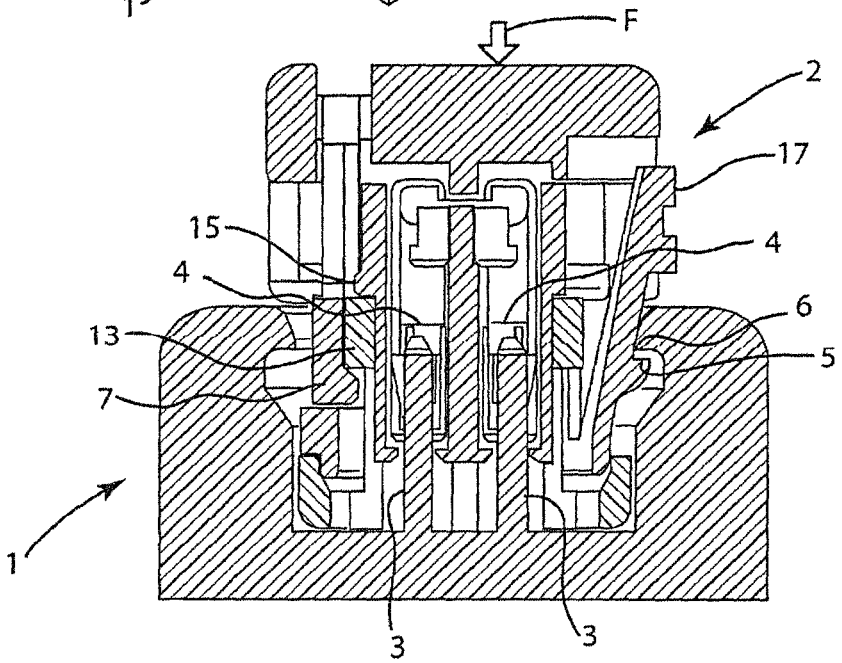
FIG. 3*b* is a cross-sectional view of the squib connector and squib assembly of the electrical connector of the invention, taken at section b-b shown in FIG. 1*a*, at the fully mated and locked insertion position.

The electrical connector includes squib assembly 1 and squib connector 2, as shown in FIGS. 1*a*-3*b*. The squib assembly 1 is formed of an electrical insulating material and includes pin contacts 3. The squib connector is formed of an electrical insulating material and includes socket contacts 4 for accepting the pin contacts 3 when connecting the squib connector and squib assembly. The squib connector 2 is mated with the squib assembly 1 to a depth at which lock lever 5 on squib connector 2 engages lip 6 on squib assembly 1, as shown in FIGS. 3*a* and 3*b*. The lock lever and lip form a retaining means for retaining the squib connector and squib assembly of the electrical connector in a fully mated condition.

The squib connector includes a spring 7. In FIGS. 1*a*-3*b*, only a portion of spring 7 is shown, as the drawings are cross-sectional views in order to more clearly show internal components of the squib connector and squib assembly. The complete spring is shown in detail in FIGS. 5*a*-6*b*.

Figure 1A:
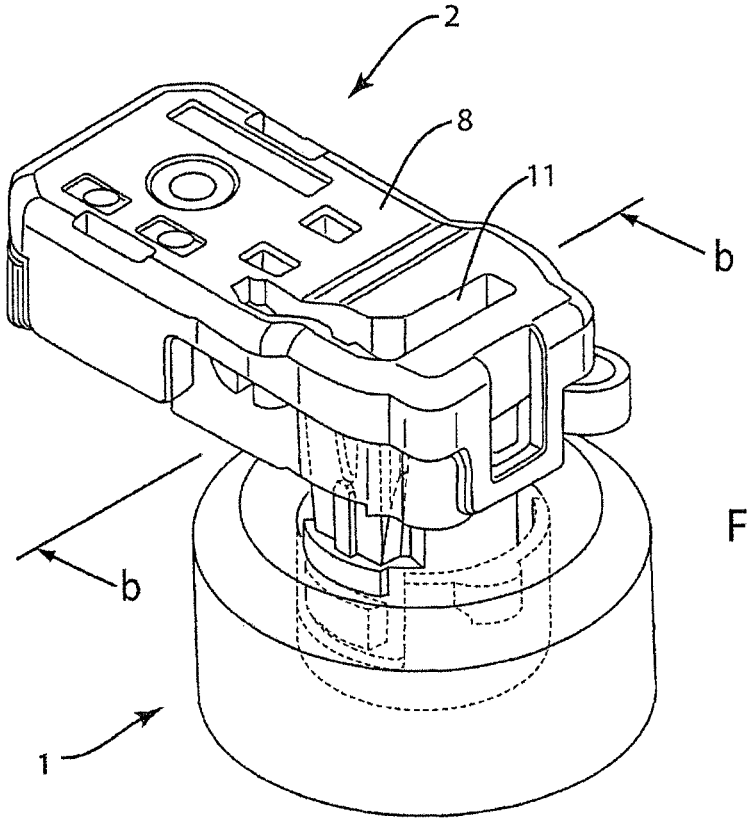
FIG. 1*a* is a perspective view of a squib assembly and a squib connector of the electrical connector of the invention, arranged at a pre-set insertion position.

In FIGS. 1*a* and 1 *b*, the squib connector 2 and squib assembly 1 are positioned at a pre-set position in preparation for mating the squib connector and squib assembly. At this position, spring 7 has an un-deformed shape. The un-deformed shape is best shown in FIGS. 5*a*-6*b*.

Figure 4:
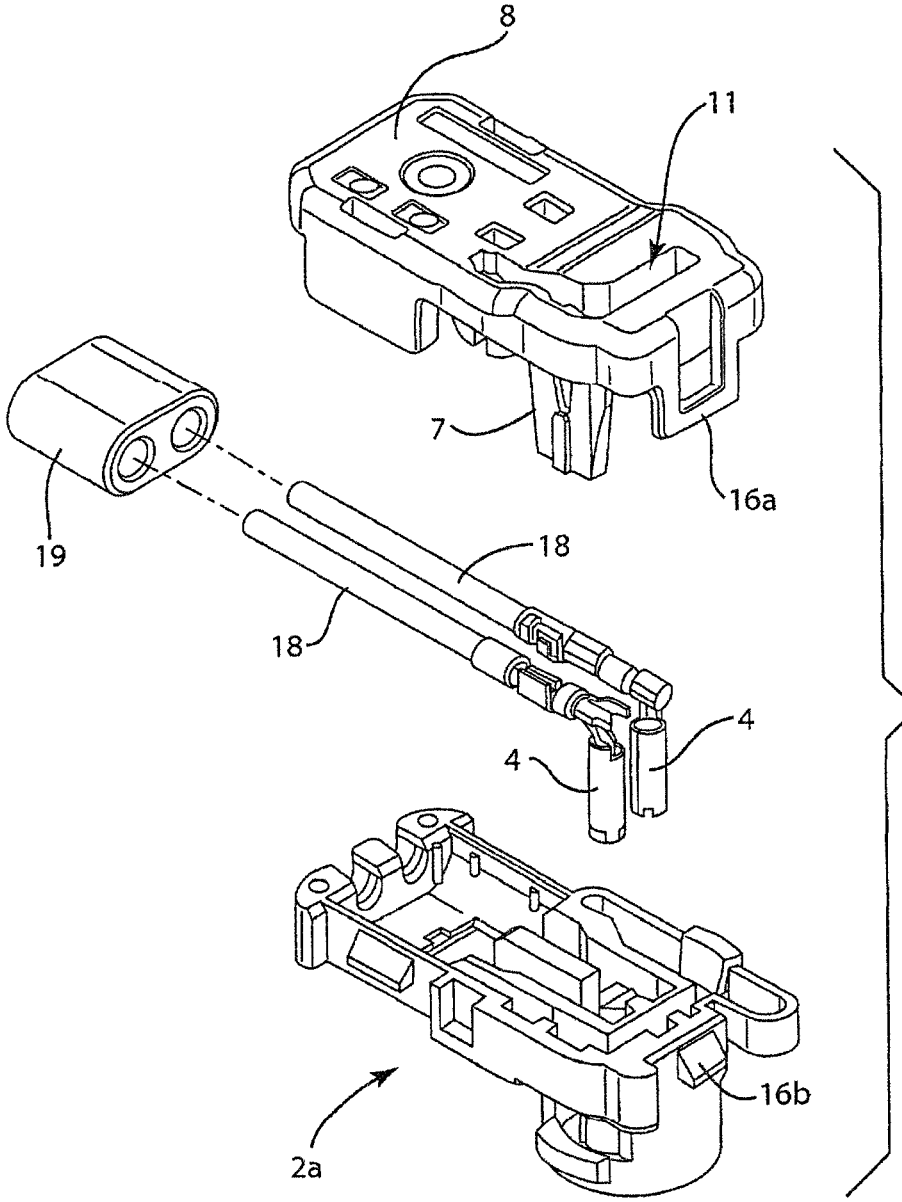
FIG. 4 is a perspective view of the squib connector of the invention, showing individual components thereof.
Figure 5A:
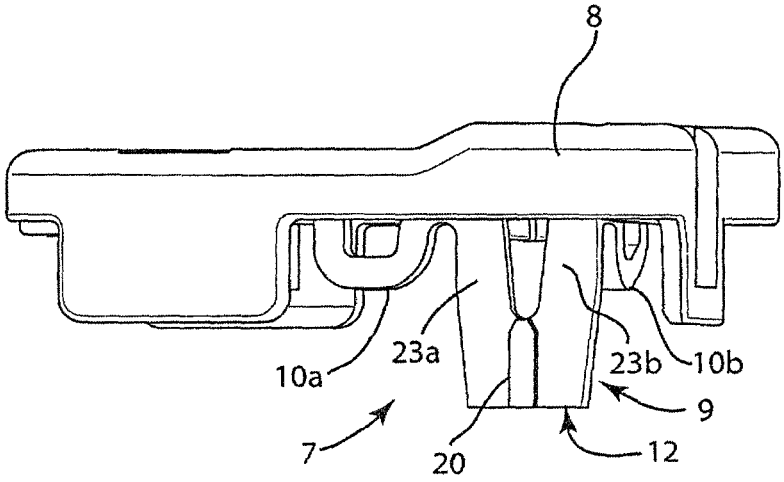
FIG. 5*a* is a front perspective view of a spring portion of the squib connector of the invention in an embodiment having the spring formed as a portion of the top cover.
Figure 5B:
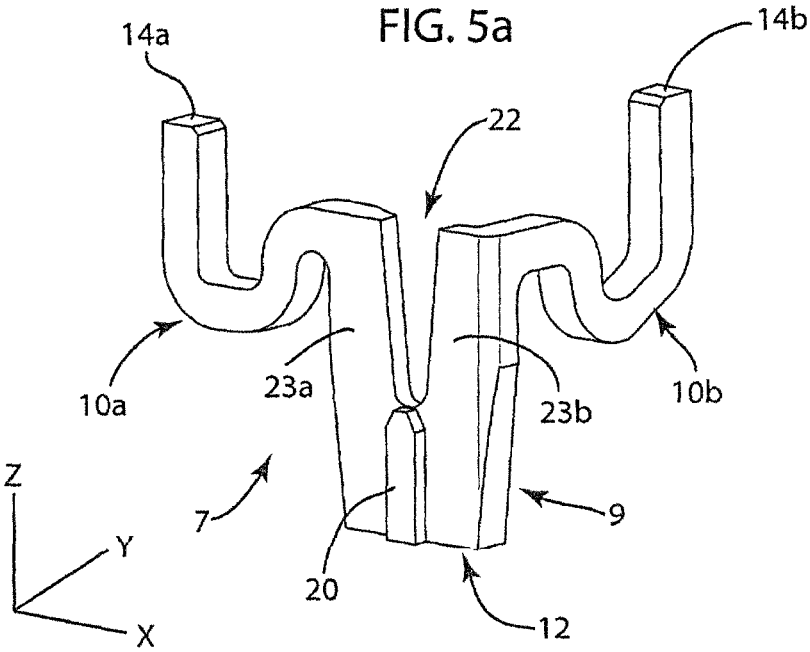
FIG. 5*b* is a front perspective view of a spring portion of the squib connector of the invention in an embodiment having the spring formed as a separate component.
Figure 6A:
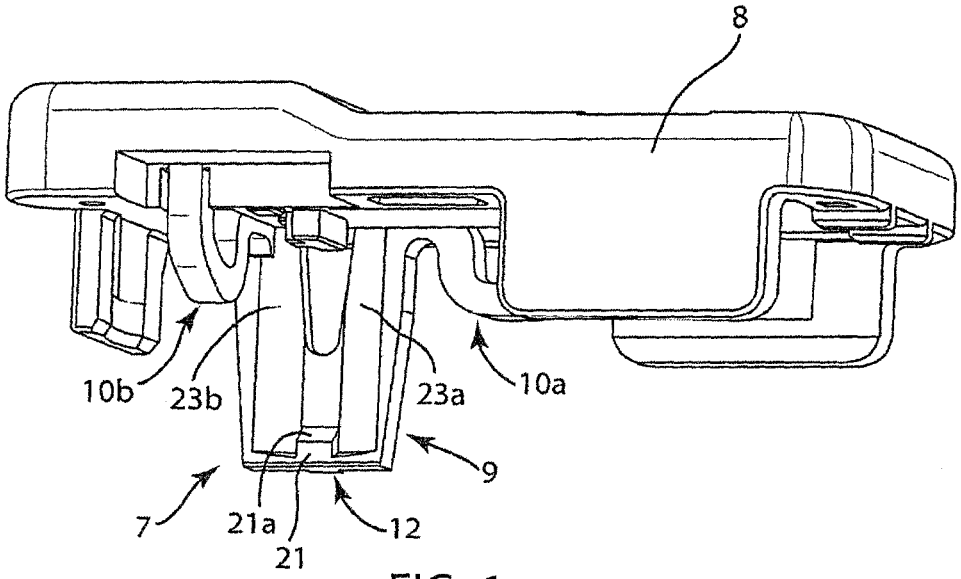
FIG. 6*a* is a rear perspective view of a spring portion of the squib connector of the invention in an embodiment having the spring formed as a portion of the top cover.
Figure 6B:
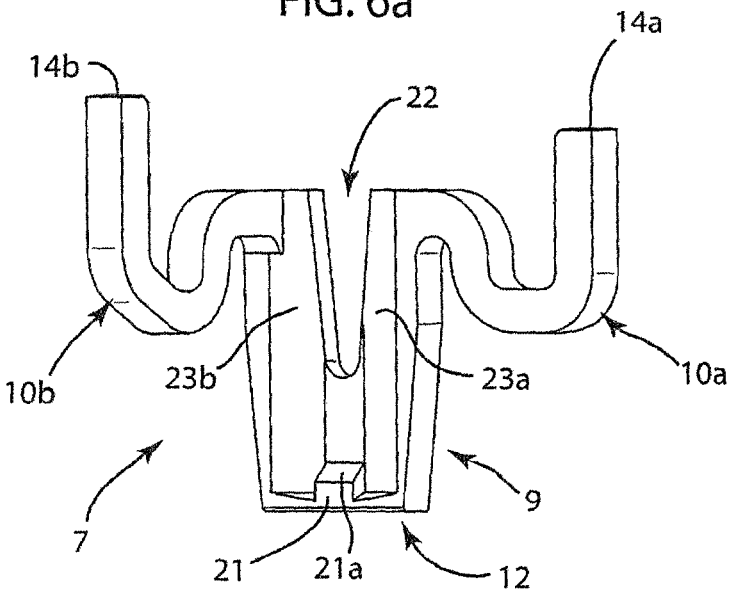
FIG. 6*b* is a rear perspective view of a spring portion of the squib connector of the invention in an embodiment having the spring formed as a separate component.

In FIGS. 5*a* and 6*a*, spring 7 is formed as one piece with top cover 8. In FIGS. 5*b* and 6*b*, spring 7 is formed as a separate piece, which is insertable into top cover 8 of the squib connector. The shape of the spring itself is preferably the same for both embodiments. The spring is shaped to have a body portion 9 and arm portions 10*a* and 10*b*. For use of either embodiment of the spring, shown in FIGS. 5*a*-6*b*, it is necessary that an L-shaped opening be present in top cover 8, as shown at 11 in FIGS. 1*a* and 4, in order that arms 10*a* and 10*b* can freely flex when force is applied to connect squib assembly 1 and squib connector 2. A lower edge 12 of spring 7 bears against a ledge 13, which is a component of the squib assembly 1. To mate the squib connector and squib assembly, force, as indicated at F in FIGS. 1 *b*, 2*b* and 3*b*, is applied to the squib connector 2, while supporting the squib assembly 1. As the force is applied, the squib connector and squib assembly progress toward engagement, as shown in various stages in FIGS. 1*a*-3*b*. During the progressive stages shown in FIGS. 1*a*-3*b*, spring 7 progressively deforms to develop a resisting force of the spring, which opposes force F. The resisting force F attempts to separate the squib connector and squib assembly. Referring to FIGS. 5*b* and 6*b*, the spring is deformed in a manner in which ends 14*a* and 14*b* of arm portions 10*a* and 10*b* of the spring, and lower edge 12 of the spring are forced toward each other.

As the squib connector and squib assembly are further mated, spring 7 continues to deform and increases in stored elastic energy. At the same time the squib connector and squib assembly are further mated, spring actuator 15 moves downward, in relation to the squib assembly 1, but lower edge 12 of spring 7 does not move downward because it is bearing against ledge 13 of the squib assembly 1. As shown in FIGS. 2*a* and 2*b*, spring activator 15 is approaching lower edge 12 of spring 7, which is bearing on ledge 13. At a point when spring activator 15 passes behind lower edge 12 of spring 7, the lower edge 12 of spring 7 is displaced from ledge 13 by the spring activator and spring 7 returns to its original un-deformed shape. The displacement of spring 7 from ledge 13 takes place as lock lever 5 is at its maximum deflection and is about to engage lip 6.

When lower edge 12 of spring 7 is displaced from ledge 13, force F is no longer opposed by spring 7, and the entire force F is instantly applied to driving squib connector 2 into squib assembly 1, at which point lock lever 5 engages lip 6. The retaining means, lock lever 5, is self-activating on lip 6. That is lock lever 5 is biased toward lip 6, and engages lip 6 when it clears lip 6, as the squib connector and squib assembly are fully mated.

Lower edge 12 of spring 7, following its displacement from ledge 13, rests beneath ledge 13 in a recess, as shown in FIG. 3*b*. In the area of the ledge, clearance must be provided for the spring to be displaced from the ledge and freely return to its original un-deformed shape with the lower edge 12 disposed beneath ledge 13.

Complete mating of the squib connector and squib assembly is assured, because if the lower edge 12 is not displaced from ledge 13 and lock lever 5 does not engage lip 6, the squib connector will be automatically rejected away form the squib assembly by action of the spring. This automatic rejection is referred to as "No Go" of the "Go/No Go" function. If lock lever 5 engaged lip 6, when the squib connector and squib assembly are fully mated, it is considered as "Go". The distinguishing "Go/No Go" feature ensures the electrical connector system is either fully and correctly mated, or completely separated. No grey zone can exist when mating the squib connector and squib assembly. Thus an incomplete mating condition is avoided.

As shown in FIG. 4, the squib connector 2 can be molded to include a number of parts. In FIG. 4, a body 2*a* of the squib connector is shown having a cover 8, which can be held in place by a retainer mechanism, such as 16*a* and 16*b*, on each end of the cover and body. In FIG. 4, spring 7 is shown as being molded as one piece with top cover 8.

Removal of the top cover 8 from the body 2*a* enables placement of electrical wires 18, which are connected to socket contacts 4, and also insulator 19, if necessary. The components shown in FIG. 4 are assembled prior to mating squib connector 2 and squib assembly 1.

To remove the squib connector from the squib assembly, it is only necessary to press release lever 17, as shown in FIGS. 3*a* and 3*b*, to release lock lever 5 from engagement with lip 6.

The material and shape of spring 7 is an important consideration of the invention. Without the features of the spring, described below, the connector may not operate in the above-described manner to assure proper connection of the squib assembly, which is a part of critical safety device in products of the automotive industry.

FIGS. 5*b* and 6*b* are used to fully describe details of spring 7. It is to be understood that spring 7 shown in FIGS. 5*a* and 6*a*, which is formed as one piece with top cover 8, has the same properties as the spring shown in FIGS. 5*b* and 6*b* which are a separate piece from top cover 8. In the embodiment of the spring shown in FIGS. 5*a* and 6*a* ends of arms 10*a* and 10*b* of spring 7 bear on the top cover at arm ends 14*a* and 14*b*.

FIG. 5*b* is a perspective view showing a front face of spring 7. FIG. 6*b* is a perspective view showing a rear face of spring 7. A lower portion of the spring is referred to as spring body 9 and numeric indicators 10*a* and 10*b* indicate arms of the spring. The spring body 9 has a lower portion that is solid and an upper portion having a central opening 22 extending upwardly to an upper edge of the spring body, the opening 22 partially define first and second shoulders 23*a* and 23*b*. Arms 10*a* and 10*b* extend outwardly from shoulders 23*a* and 23*b*, respectively, with each arm having an end 14*a* and 14*b*, respectively. The arms 10*a* and 10*b* of spring 7 preferably are in planes that are at substantially 90° to each other, however, other angular relationships are possible in practice of the invention.

Spring 7 is preferably molded of PBT (Polybutylene terephthalate), although other materials having similar properties can be used in practice of the invention.

Spring body 9 of spring 7, is preferably tapered along edges thereof in order to facilitate the assembly of top cover 8 and squib connector body 2*a*, as shown in FIG. 4. On the front face of spring body 9, as shown in FIG. 5*b*, guide rib 20 is provided to act as a guide during assembly of top cover 8 and squib connector body 2*a*, as shown in FIG. 4. An even more important function of the guide rib 20 is to guide the spring body during activation of the spring as the squib connector 2 is mated with squib assembly 1. The guide rib 20 slides in a guide groove in the squib assembly as the spring body is forced off ledge 13 and travels to below ledge 13, as shown in FIG. 3*b*.

Another feature of spring 7, shown in FIGS. 6*a* and 6*b*, on a rear face of the spring body 9, is a protrusion 21 near the lower horizontal portion 12 at its center. The protrusion has a sloping top portion 21*a* that facilitates action of the spring actuator as the squib connector and squib assembly are mated. The protrusion also acts to hold the squib connector and squib assembly together when fully mated, although lock lever 5 and lip 6 are the primary means for holding them together.

As the squib connector and squib assembly are forced together the resulting resisting force of spring 7 is developed by the distortion of the spring, as the spring continually attempts to return to the un-deformed shape. Referring to FIG. 6*b*, during mating, ends 14 of arms 10*a* and 10*b* are forced toward lower edge 12 thus deforming the spring.

Another important feature of spring 7 is the opening 22, in the upper portion of the spring body. The opening 22 extends upwardly to the upper edge of the spring body to partially define first and second shoulders 23*a* and 23*b*. The opening is preferable V-shaped, as shown, but does not necessarily need to be that shape. Opening 22 narrows the upper portion of the spring body to form an S-shaped portion consisting of arm 10*a* and shoulder 23*a* along an X direction. (see the Cartesian Coordinate System shown in FIG. 5*b*). As the spring is distorted the "S" of arm 10*a* and shoulder 23*a* is elongated along the X direction to develop part of the resisting force of the spring.

Also, opening 22 facilitates a distortion of arm 10*b* and shoulder 23*b* along the Y direction. The combination of the distortion of the arms and shoulders, aided by opening 22, produces the resisting force of spring 7, which is needed to carry out the invention.

Figure 1B:
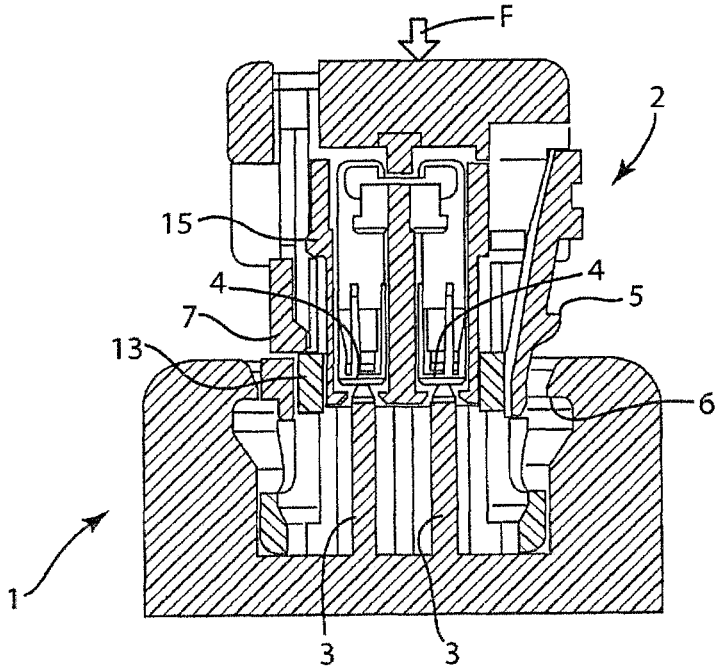
FIG. 1 *b* is a cross-sectional view, taken at section b-b shown in FIG. 1*a*, of the squib assembly and squib connector of the electrical connector of the invention, arranged at the pre-set insertion position.
Figure 7:
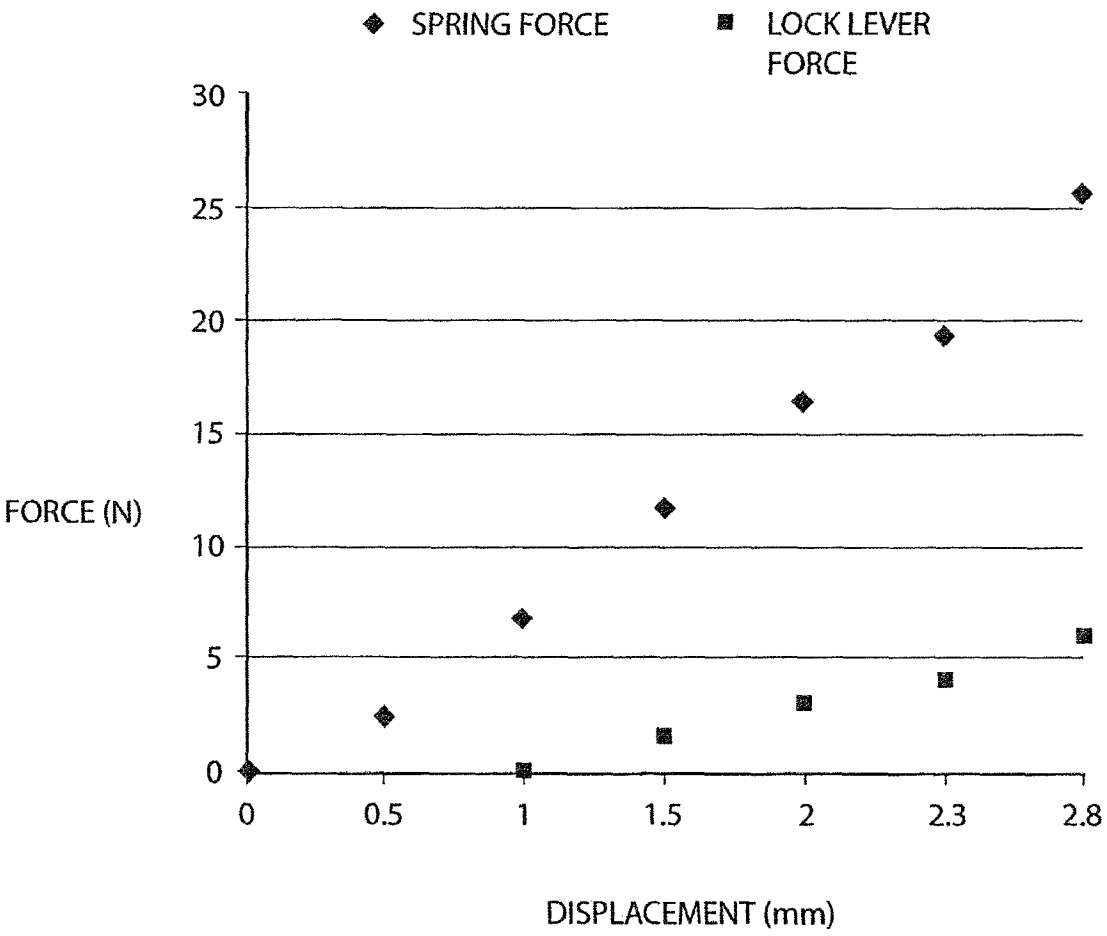
FIG. 7 is a graph showing 1) downward force of the spring on a ledge of the squib assembly vs. vertical distance (displacement) moved by the squib connector relative to the squib assembly when connecting the squib connector and the squib assembly, and 2) outward force of a lock lever on a lip vs. vertical distance (displacement) moved by the squib connector relative to the squib assembly when connecting the squib connector and the squib assembly.

FIG. 7 is a graph showing 1) downward force of the spring on ledge 13 of the squib assembly 1 vs. vertical distance (displacement) of the squib connector 2 relative to the squib assembly 1, and 2) outward force of a lock lever 5 on lip 6 vs. vertical distance (displacement) of squib connector 2 relative to squib assembly 1. The displacement shown in mm on the horizontal axis is the distance moved by the squib connector relative to the squib assembly. The graph tracks the spring force and lock lever force, beginning when the squib connector and the squib assembly are disposed relative to each other as shown in FIGS. 1*a* and 1*b* (0.0 mm), until the squib connector and squib assembly are disposed relative to each other as shown in FIGS. 3*a* and 3*b* (2.8 mm). It is preferred that the values of the displacement and forces be near the indicated ranges, however practice of the invention does not require the same values as shown. The values of force are shown in Newtons (N).

The present invention is not limited to the above-described embodiments and various modifications in design, structural arrangement or the like may be used without departing from the scope or equivalents of the present invention.

The invention claimed is:

1. An electrical connector, comprising a squib connector of an electrical insulating material for housing a plurality of socket contacts;

a squib assembly of an electrical insulating material for housing a plurality of pin contacts for insertion in the socket contacts when the squib connector and squib assembly are moved together in a mating direction and mated;

a retaining means for retaining the squib connector and squib assembly in a fully mated condition, the retaining means being self activated when the squib connector and squib assembly are fully mated;

a spring, acting in a direction opposite the mating direction, to provide a resisting force to oppose mating; wherein during the application of a mating force to overcome the resisting force of the spring and move the squib connector and squib assembly in the mating direction, and prior to the squib connector and squib assembly reaching the fully mated condition, removal of the resisting force of the spring is triggered and the mating force is instantly applied to moving the squib connector and squib assembly to the fully mated condition, whereat the retaining means is activated, and the spring is formed of a plastic material to have:

a spring body having a lower portion and an upper portion, the upper portion having a central opening extending upwardly to an upper edge of the spring body to partially define first and second shoulders, first and second arms extending outwardly from the first and second shoulders respectively, and the lower portion, shoulders and first arm disposed in a first plane and the second arm disposed in a second plane intersecting the first plane;

the spring is formed to provide a resistance force when ends of the arms are moved toward a lower edge of the spring;

the ends of the arms bear on the squib connector;

the squib assembly includes a ledge; and the lower edge of the spring bears on the ledge.

2. The electrical connector of claim 1, wherein the squib connector includes a spring activator; and during movement of the squib connector and squib assembly in the mating direction, the spring activator contacts the spring to displace the spring from the ledge, thereby removing the resisting force of the spring.

3. The electrical connector of claim 1, wherein the retaining means comprises:

a lip on the squib assembly; and a lock lever on the squib connector, the lock lever being biased toward the lip and free to engage the lip, during mating, only when the squib connector and squib assembly are fully mated.

4. The electrical connector of claim 1, wherein the spring body includes a guide rib for guiding the spring in the squib assembly.

5. The electrical connector of claim 1, wherein the spring body includes a protrusion on the lower edge, the protrusion being contacted by the spring activator during displacing the spring from the ledge.

6. The electrical connector of claim 1, wherein the spring is molded of plastic.

7. The electrical connector of claim 6, wherein the spring is molded of PBT.

8. The electrical connector of claim 1, wherein the spring and squib connector are molded as a single piece.

9. The electrical connector of claim 8, wherein the squib connector includes a spring activator; and during movement of the squib connector and squib assembly in the mating direction, the spring activator contacts the spring to displace the spring from the ledge, thereby removing the resisting force of the spring.

10. The electrical connector of claim 8, wherein the retaining means comprises:

a lip on the squib assembly; and a lock lever on the squib connector, the lock lever being biased toward the lip and free to engage the lip, during mating, only when the squib connector and squib assembly are fully mated.

11. The electrical connector of claim 8, wherein the spring body includes a guide rib for guiding the spring in the squib assembly.

12. The electrical connector of claim 8, wherein the spring body includes a protrusion on the lower edge, the protrusion being contacted by the spring activator during displacing the spring from the ledge.

13. The electrical connector of claim 8, wherein the spring and squib connector are molded of plastic.

14. The electrical connector of claim 13, wherein the spring and squib connector are molded of PBT.

* * * * *